US009711895B1

(12) United States Patent
Kionka

(10) Patent No.: US 9,711,895 B1
(45) Date of Patent: Jul. 18, 2017

(54) VEHICLE POWER ADAPTER AND METHOD OF USE

(71) Applicant: Thomas Kionka, Charlotte, NC (US)

(72) Inventor: Thomas Kionka, Charlotte, NC (US)

( * ) Notice: Subject to any disclaimer, the term of this patent is extended or adjusted under 35 U.S.C. 154(b) by 0 days.

(21) Appl. No.: 15/009,502

(22) Filed: Jan. 28, 2016

Related U.S. Application Data

(60) Provisional application No. 62/109,174, filed on Jan. 29, 2015.

(51) Int. Cl.
*H01R 13/627* (2006.01)
*H01R 24/20* (2011.01)
*H01R 43/26* (2006.01)

(52) U.S. Cl.
CPC ..... *H01R 13/6276* (2013.01); *H01R 13/627* (2013.01); *H01R 24/20* (2013.01); *H01R 43/26* (2013.01)

(58) Field of Classification Search
CPC ..... H01R 24/58; H01R 24/60
USPC ..... 439/668, 669, 265
See application file for complete search history.

(56) References Cited

U.S. PATENT DOCUMENTS 5,158,484 A * 10/1992 Chou ..... H01R 24/58 439/668
5,569,053 A * 10/1996 Nelson ..... B60N 3/14 439/638
6,394,851 B1 * 5/2002 Paciorek ..... B60N 3/14 439/668
6,478,628 B1 * 11/2002 Ming ..... B60N 3/14 439/640
7,294,022 B1 * 11/2007 Cheng ..... H01R 13/70 200/530
7,377,823 B2 * 5/2008 Chen ..... H01R 12/585 439/751
7,611,388 B1 * 11/2009 Lee ..... H01R 13/62 439/668
8,753,152 B1 * 6/2014 Tsai ..... A47G 33/06 362/202
8,777,646 B2 * 7/2014 Doubt ..... H01R 13/7137 439/265
2005/0153602 A1 * 7/2005 Belanger, Jr. ..... H01R 33/94 439/668
2013/0078832 A1 * 3/2013 Vardanyan ..... H01R 27/00 439/131
2016/0006193 A1 * 1/2016 Liu ..... H01R 24/58 439/628

* cited by examiner

*Primary Examiner* — Tulsidas C Patel
*Assistant Examiner* — Marcus Harcum
(74) *Attorney, Agent, or Firm* — Eldredge Law Firm; Richard G. Eldredge

(57) ABSTRACT

A vehicle electrical adapter system includes an upper portion having a body with an electrical terminal extending from a top surface of the body; a lower portion forming a cavity; and an attachment device disposed between the upper portion and the lower portion, the attachment device being configured to engage with an inner surface of a cigarette lighter housing as the upper portion slides relative to the lower portion. The method includes creating a friction fit between the inner surface of the housing with the attachment device.

8 Claims, 3 Drawing Sheets

VEHICLE POWER ADAPTER AND METHOD OF USE

BACKGROUND

1. Field of the Invention

The present invention relates generally to adapters, and more specifically, to a vehicle power adapter for a cigarette receptacle.

2. Description of Related Art

Vehicles adapters are well known in the art and are effective means to provide electrical power to an electronic device during travel. For example, FIG. 1 is a front view of a conventional adapter 101 having a contoured body 103 with a fastening device 105 having one or more metallic spring-loaded prongs 107, 109 adapted to engage with an inner surface area of a vehicle cigarette lighter device (not shown). The prongs 107, 109 are configured to secure the adapted within the housing of the cigarette lighter device.

A commonly known disadvantage with adapter 101 is the tendency to dislodge from the housing of the cigarette lighter device, which in turn could cause distraction and potential accidents during operation of the vehicle. This feature is caused by the flexible spring-loaded prongs loosing rigidity after time, resulting in a loose fit between the housing of the cigarette lighter device and the body 103 of the adapter 101.

Accordingly, although great strides have been made in the area of vehicle adapters, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
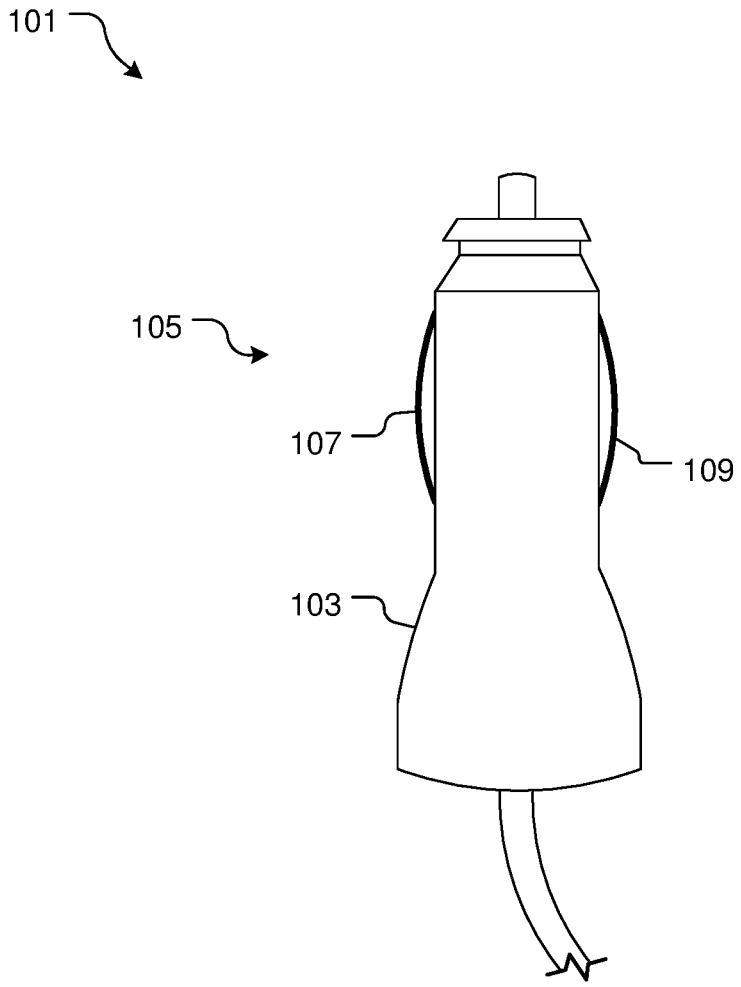
FIG. 1 (Prior Art)
FIG. 1 is a front view of a conventional adapter.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional vehicle adapters. Specifically, the system and method of the present application provides rapid and effective means to remove the adapter from the outlet while also retaining the longetivity of the adapter over time. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIGS. 2A-4B illustrate various views of a vehicle adapter system 201 in accordance with a preferred embodiment of the present application. It will be appreciated that system 201 overcomes one of more of the above-listed problems commonly associated with the conventional vehicle adapters.

Adapter system 201 includes an upper portion 203 configured to slidingly engage with a lower portion 205. During use, the lower portion 205 partially engages with an inner surface 301 of a housing 303 associated with a cigarette device (see, FIG. 3) while the upper portion 203 is completely disposed within the housing 303 during use.

Figure 3:
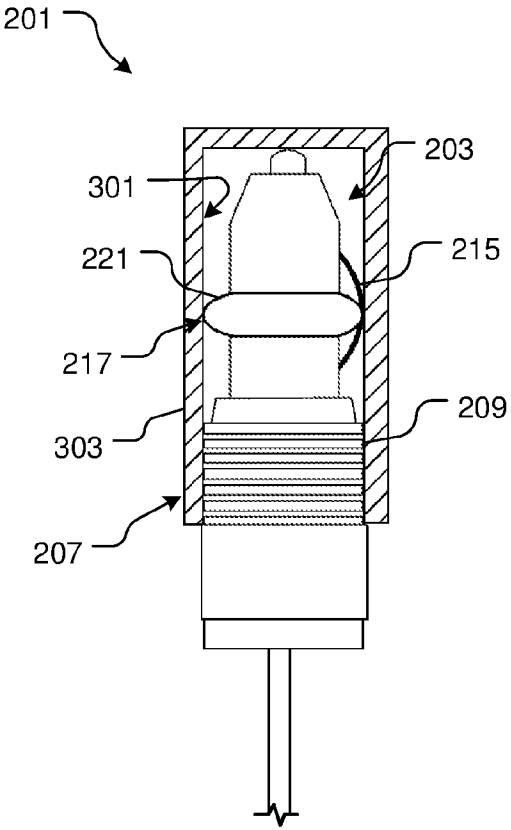
FIG. 3 is a front view of the adapter of FIG. 2B secured within a housing of a cigarette lighter apparatus taken at IV-IV.

The lower portion 205 includes a friction device 207 having a plurality of ribs 209 ending around the periphery of the body. As shown in FIG. 3, the plurality of ribs 209 are configured to engage with inner surface 301 of housing 303. In one contemplated embodiment, the ribs could be composed of an elastic material, which in turn could facilitate easy and rapid removal of the adapter 201 during use.

Figure 2B:
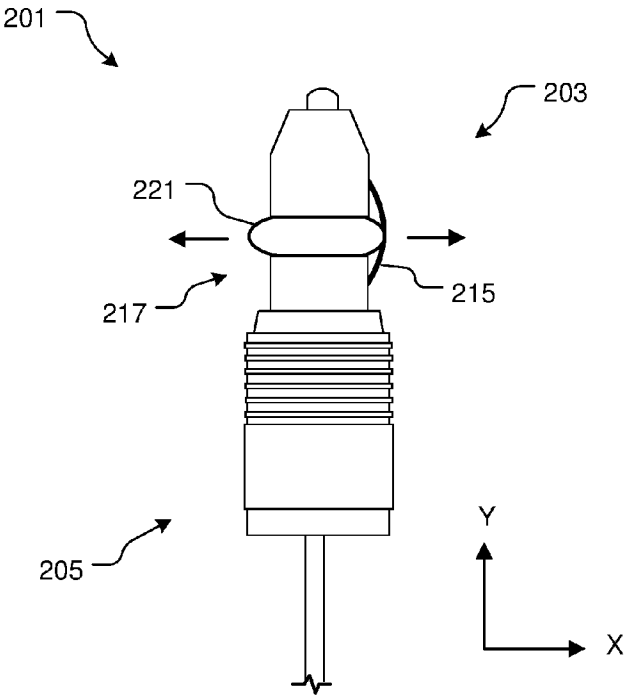
FIGS. 2A and 2B are front views of an adapter in accordance with a preferred embodiment of the present application.
Figure 2A:
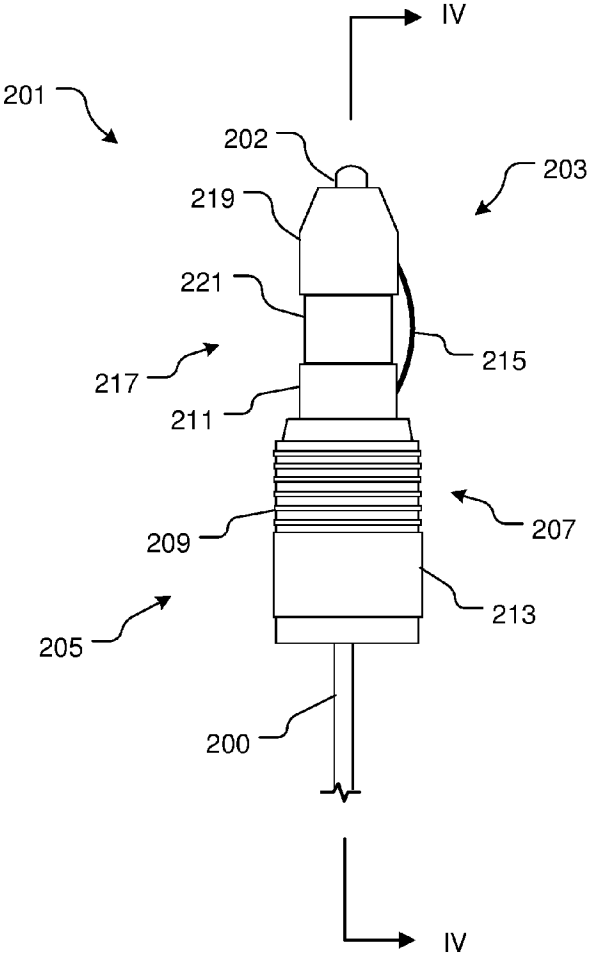

Lower portion 205 includes a protrusion 211 integral to body 213 and configured to rigidly secure to a metallic prong 215. The metallic prong 215 is preferably spring loaded and is adapted to move in a direction along axis X, as depicted in FIG. 2B, as the upper portion 203 moves relative to the lower portion 205.

System 201 is further provided with an attachment device 217 disposed between the body 219 of upper portion 203 and lower portion 205. In the preferred embodiment, the attachment device is configured to engage with the inner surface 301 of housing 303 by bulging in a direction along axis X relative to the longitudinal axis Y of the adapter. To achieve this feature, the attachment device 217 is composed of an elastic material 221 configured to deform in shape and size as the lower and upper portions move relative to each other. The deformation of the elastic material 221 causes a friction fit seal between the adapter and the inner surface of the housing.

Referring now specifically to FIG. 3, the adapter system 201 is shown partially disposed within a cigarette lighter housing 303. One of the unique features believed characteristic of the present application is the use of both attachment device 217 and friction device 207 to secure the adapter to the housing. It should be understood that sufficient force exerted by the user will release the devices 217, 207 from within the housing.

Figure 4B:
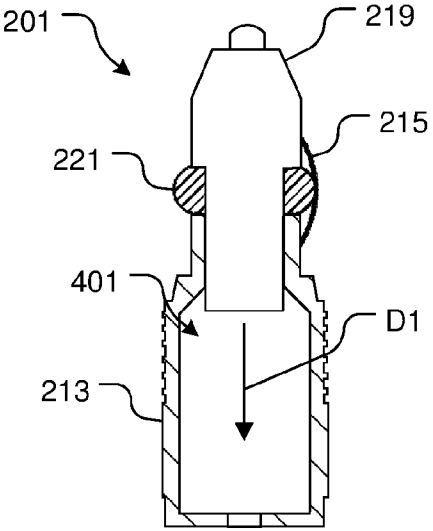
FIGS. 4A and 4B are front cross-sectional views of the adapter of respective FIGS. 2A and 2B.
Figure 4A:
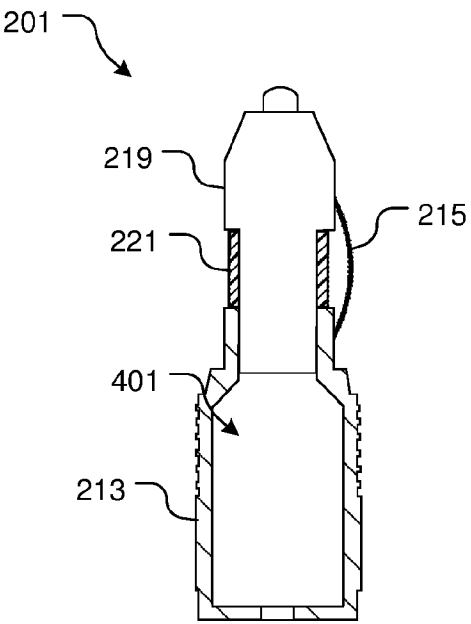

In FIGS. 4A and 4B, a front cross-sectional view of the system 201 is shown, wherein the body 219 is adapted to slidingly engage with body 213 of the lower portion. In the contemplated embodiment, both bodies 213 and 219 are hollow, which in turn allows the electrical components, e.g., cord 200 to pass therethrough. In the exemplary embodiment, body 213 forms a hollow cavity 401 adapted to receive body 219 therein as the upper portion is moved relative to the lower portion, as depicted with arrow D1.

It will be appreciated that electrical energy from housing 303 is transferred through prong 215, terminal 202 and through wire 200 in the contemplated embodiment. However, it will be appreciated that the features discussed herein could also include a USB adapter in lieu of wire 200 and/or other terminal and devices operably associated with transferring electrical energy.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A vehicle electrical adapter system, comprising:

an upper portion having a body with an electrical terminal extending from a top surface of the body;

a lower portion forming a cavity and having:

a friction device having a plurality of ribs extending from an outer surface; and a protrusion;

an electrical prong extending from the protrusion to the body of the upper portion; and an attachment device disposed between the upper portion and the lower portion, the attachment device being configured to engage with an inner surface of a cigarette lighter housing as the upper portion slides relative to the lower portion;

wherein the friction device and the attachment device are configured to engage with the inner surface of the cigarette lighter housing.

2. The system of claim 1, wherein the electrical prong is spring-loaded and rigidly attached to both the upper portion and the lower portion.

3. The system of claim 1, wherein the attachment device is composed of an elastic material configured to bulge in shape as the upper portion slides relative to the lower portion.

4. The system of claim 1, wherein the body of upper portion is configured to slidingly engage within the cavity of the lower portion.

5. The system of claim 1, wherein the terminal and the electrical prong are configured to receive electrical energy from the housing of the cigarette lighter.

6. A method, comprising:

providing the system of claim 1, creating a first friction fit between the inner surface of the cigarette lighter housing with the attachment device.

7. The method of claim 6, further comprising:

creating a second friction fit between the inner surface of the cigarette lighter housing with the friction device.

8. The method of claim 6, further comprising:

creating a third friction fit between the inner surface of the cigarette lighter housing with the electrical prong, wherein the electrical prong is spring-loaded and secured to both the upper portion and the lower portion.

* * * * *